US007493730B2

(12) United States Patent
Fennell, Jr.

(10) Patent No.: US 7,493,730 B2
(45) Date of Patent: Feb. 24, 2009

(54) METHOD OF CREATING A ROOF VENTING SPACE

(76) Inventor: Harry C. Fennell, Jr., P.O. Box 87, North Thetford, VT (US) 05054

( * ) Notice: Subject to any disclaimer, the term of this patent is extended or adjusted under 35 U.S.C. 154(b) by 355 days.

(21) Appl. No.: 10/961,702

(22) Filed: Oct. 8, 2004

(65) Prior Publication Data

US 2005/0076607 A1 Apr. 14, 2005

Related U.S. Application Data

(60) Provisional application No. 60/509,618, filed on Oct. 8, 2003.

(51) Int. Cl.
*E04D 13/00* (2006.01)
*F24F 7/02* (2006.01)

(52) U.S. Cl. ..... 52/199; 52/90.1; 52/302.3; 52/745.06; 52/95; 52/302.1; 454/365

(58) Field of Classification Search ..... 52/198, 52/199, 95, 90.1, 90.2, 92.1, DIG. 17, 302.3, 52/745.06, 712, 302.1, 275, 276, 278, 279; 454/364, 365, 366, 368
See application file for complete search history.

(56) References Cited

U.S. PATENT DOCUMENTS

| | | | | | |
|---|---|---|---|---|---|
| 2,439,095 | A | * | 4/1948 | Mitchell | 52/22 |
| 2,855,869 | A | * | 10/1958 | Munters et al. | 52/302.3 |
| 3,333,875 | A | * | 8/1967 | Tracy | 403/170 |
| 3,423,898 | A | * | 1/1969 | Coloney et al. | 52/713 |
| 3,797,180 | A | * | 3/1974 | Grange | 52/95 |
| 3,972,164 | A | | 8/1976 | Grange | |
| 4,011,697 | A | | 3/1977 | Fedolfi | |
| 4,635,419 | A | | 1/1987 | Forrest | |
| 4,658,552 | A | | 4/1987 | Mulford | |
| 4,788,801 | A | * | 12/1988 | Jones | 52/57 |
| 4,942,699 | A | * | 7/1990 | Spinelli | 52/57 |
| 5,240,342 | A | | 8/1993 | Kresa, Jr. | |
| 5,341,610 | A | * | 8/1994 | Moss | 52/82 |
| 5,399,044 | A | * | 3/1995 | Gilb | 403/231 |
| 5,524,397 | A | * | 6/1996 | Byers et al. | 52/92.2 |
| 5,713,158 | A | * | 2/1998 | Gibbs | 52/57 |
| 5,797,694 | A | | 8/1998 | Breivik | |
| 5,830,059 | A | * | 11/1998 | Sells | 454/365 |
| 5,941,028 | A | * | 8/1999 | Hicks | 52/95 |
| 5,946,868 | A | * | 9/1999 | Morris | 52/199 |

(Continued)

FOREIGN PATENT DOCUMENTS

EP 220771 A2 * 5/1987

(Continued)

*Primary Examiner*—Robert J Canfield
*Assistant Examiner*—Jessie Fonseca
(74) *Attorney, Agent, or Firm*—Robert R. Deleault, Esq.; Mesmer & Deleault, PLLC

(57) ABSTRACT

A method of creating a roof venting space includes assembling a plurality of roof rafters where at least one end of the plurality of roof rafters are assembled to a surface to define a space between the one end of the plurality of roof rafters and the surface, attaching roof sheathing to the outside of the plurality of roof rafters where the roof sheathing covers the space creating a continuous internal ducting space, and connecting a vent to the continuous internal ducting space.

13 Claims, 11 Drawing Sheets

U.S. PATENT DOCUMENTS 5,947,817 A * 9/1999 Morris et al. ..... 454/365
6,077,159 A * 6/2000 Clayton ..... 454/250
6,223,481 B1 * 5/2001 Rickman ..... 52/90.1
6,240,690 B1 * 6/2001 James et al. ..... 52/302.3
6,241,602 B1 * 6/2001 Allen ..... 454/280
6,299,528 B1 * 10/2001 Hansen ..... 454/365
6,301,855 B1 10/2001 Aerni
6,361,434 B1 * 3/2002 Brandon ..... 454/365
6,389,770 B1 * 5/2002 Santavicca ..... 52/474
6,418,678 B2 * 7/2002 Rotter ..... 52/199
6,447,390 B1 9/2002 O'Hagin
6,460,309 B1 * 10/2002 Schneider ..... 52/729.1
6,463,711 B1 10/2002 Callies
6,482,084 B2 * 11/2002 Hansen ..... 454/365
6,558,251 B2 * 5/2003 Sells ..... 454/359
6,579,171 B2 * 6/2003 Lawless et al. ..... 454/365
6,599,184 B2 * 7/2003 Morris ..... 454/365
6,623,354 B2 * 9/2003 Morris et al. ..... 454/365
6,796,100 B1 * 9/2004 Venezia ..... 52/741.1
6,997,800 B1 * 2/2006 Kohler ..... 454/365
2002/0086634 A1 * 7/2002 Sells ..... 454/365
2002/0194799 A1 * 12/2002 Sharp et al. ..... 52/198
2003/0140582 A1 * 7/2003 Sells ..... 52/198
2005/0126088 A1 * 6/2005 Rotter ..... 52/198

FOREIGN PATENT DOCUMENTS

JP 01210553 A * 8/1989

* cited by examiner

METHOD OF CREATING A ROOF VENTING SPACE

This application claims the benefit of U.S. Provisional Patent Application No. 60/509,618, filed Oct. 8, 2003.

BACKGROUND OF THE INVENTION

1. Field of the Invention

The present invention relates generally to construction brackets for framing. Particularly, the present invention relates to construction brackets for a roof. More particularly, the present invention relates to construction brackets for roof rafters for more efficient construction and for venting of roofs.

2. Description of the Prior Art

In wood frame building construction, a plurality of paired roof rafters are connected together forming a roof structure. Typically during construction, a ridge board is used to facilitate the roof rafter framing process. Roofs are typically vented to prevent excess heat and associated problems such as increased cooling costs in hot climates and ice formation on the roof in cold climates. The formation of ice results from a lack of free flowing air from the eaves to the ridge of the roof. The ice forms dams (known as ice dams) that cause the water from melting snow to become trapped behind the ice dam. Water then backs up under the shingles causing water damage to the roof, roof structure and internal walls and ceilings.

In roof structures that do not incorporate an attic, a ridge vent is typically installed along the ridge of the roof so that ambient air is allowed to freely flow from the eaves to the ridge vent along paths between the rafters. There are several disadvantages of using ridge vents. In cold climates, snow may accumulate on the roof and the ridge vent, thus blocking the ridge vent. Blocking of the ridge vent prevents proper venting of the roof that leads to the formation of ice dams. In addition, proper venting of roof hips or valleys or around gables tends to be ignored. This creates venting problems for construction designs that incorporate large numbers of gables and no attic space between the rafters and ceiling joists. Further, ridge vents create a ridge line that is not aesthetically pleasing. It creates the look of a misaligned ridge like a ridge cap that doesn't quite belong. This is unlike the use of roof cupolas that add an aesthetically pleasing feature to a roof or the use of gable vents.

U.S. Pat. No. 4,942,699 (1990, Spinelli) discloses a ridge vent comprising a matting or matrix of randomly convoluted polymeric filaments heat bonded to a porous sheet material layer. The sheet material layer overlies the ridge peak opening and is wrapped around the edges of the filament matrix to prevent entry of foreign material into the matrix as well as into the attic. The sheet material layer permits the flow of ventilating air through the peak opening and outwardly beneath the ridge cap shingles.

U.S. Pat. No. 6,418,678 (2002, Rotter) discloses a contoured roof ventilation system. The ventilation system has a strip with an air-permeable portion located adjacent a ridge slot. Standoff clips are provided which can be placed over the air-permeable strip at fastener locations which are located on flat portions of the roof panels. A sealing material may be place beneath the air-permeable strip at such fastener locations to prevent the ingress of moisture beneath the panels.

Both of these device suffer from the same disadvantages described earlier, i.e., the problem of snow accumulation blocking ventilation along the ridge and the unaesthetic look of a ridge vent. Consequently, the proper venting of a roof continues to be a problem.

Not only is roof venting a problem, but also connecting one rafter to another requires that the rafters be attached securely. Various hangers have been devised to facilitate the attachment of rafters and joists. The following are examples of such devices.

U.S. Pat. No. 5,797,694 (1998, Breivik) discloses an adjustable ridge connector. The adjustable ridge connector has an elongated spine with a longitudinal axis. The spine has a first portion and a second portion. First and second opposed ears extend from the first portion of the spine in a direction transverse to the axis. Each of the ears has distal ends. First and second opposed flanges extend from the spine in a direction transverse to the longitudinal axis and are adjacent to the first and second ears. The first and second flanges form an arcuate taper towards the second portion of the spine. A first and a second seat tab extend longitudinally from the second portion of the spine in a direction transverse to the longitudinal axis and form an acute angle with respect to the longitudinal axis of the spine. Each of the seat tabs have distal ends. The flanges define a plurality of fastener openings. The openings are aligned about a plurality of vertically spaced axes. At least two sets of openings are formed by the plurality of openings; each set is distinguishable from the other for designating either skewed or non-skewed configurations.

U.S. Pat. No. 5,240,342 (1993, Kresa, Jr.) discloses a variable angle joist support. The variable angle joist support includes a base plate mounted to a first surface of a supporting beam and a pair of spaced apart support sides flexibly attached to the base plate. The support sides sandwich a joist to be supported at a variable interface angle relative to the beam. Each support side includes a support section which is positionable to fit flush against a respective side surface of the joist. The flexible attachment of the support sides to the base plate allows the support sides to pivot about a beam mounted base plate in order to receive a joist at any desired interface angle. The support sides can be flexibly attached to the base plate using hinges or malleable accordion shaped sections. The support sides can be provided with coplanar bottom flanges for support of and interconnection to a bottom surface of the joist. The support sides may be made of a malleable material or include multiple hinged support sections.

A disadvantage of these connector devices is the need to cut the butting end of the joist or rafter at the proper angle for attachment to a ridge board or other joist. This requires skill to determine the proper angle to form along with the proper length of the board. Another disadvantage is the time required to perform the cut of the joist or rafter at the proper angle for attachment to these connector devices.

Therefore, what is needed is a construction bracket that provides a more efficient way of connecting rafters during the framing/construction process. What is further needed is a construction bracket that does not require a user to perform an acute angle cut of the end of the joist or rafter before attaching to the construction bracket. What is also needed is a construction bracket that, when used to connect roof rafters at roof ridges, hips or valleys, creates a passageway to improve roof ventilation. What is yet further needed is construction bracket that forms a roof ventilation system unaffected by snow accumulation.

SUMMARY OF THE INVENTION

It is an object of the present invention to provide a construction bracket that provides a more efficient way of connecting roof rafters by decreasing framing time and reducing the number of angle cuts required to fabricate sloped roofs. It is another object of the present invention is to provide a construction bracket that eliminates the need for compound angle cuts on rafter ends for roof hips and valleys. It is still another object of the present invention to provide a construction bracket that allows for easier attachment of light framing to large structural members at angled building configurations. It is a further object of the present invention to provide an internal ducting system for venting a roof that is more aesthetic than external systems and does not increase the height of the ridge. It is yet a further object of the present invention to provide improved airflow in a ventilated roof, even roofs with multiple gables, hips and/or valleys. It is another object of the present invention to provide proper roof ventilation even when the roof is covered with snow.

The present invention achieves these and other objectives by providing a construction bracket that has at least a first flange and a second flange connected to each other along one edge of each flange forming a "V" shaped bracket, which is either at a fixed or an adjustable angle. In its simplest configuration, the first flange is configured to connect to the end of a roof rafter that is square cut. An end having a square cut is one whose end is substantially perpendicular to the length of the board. The second flange is configured to connect to the end of a second roof rafter that is the opposing rafter to the one attached to the first flange, or in the case of a shed roof, to a header board. Because the need to make angled or compound angle cuts to the ends of the rafters forming the roof structure is eliminated, the time required to frame a roof is decreased thus providing a savings on labor cost.

Using a construction bracket of the present invention to join each paired rafter, or a shed roof rafter to a header board, creates a continuous internal space at the ridge, hip, or valley of a roof bounded by a covering such as the roof sheathing, which is typically plywood, or at the junction of the rafters of a shed roof with the header wall bounded by the shed roof sheathing. Unlike the typical construction structure where a ridge board, hip board or valley board is used to facilitate connecting the paired rafters together and creating a solid junction with the sheathing along these structures, this feature of the present invention, i.e. creating a continuous internal space along the rafter/rafter junctions, allows for improved airflow and roof ventilation even when the roof is covered by snow or when a large number of gables, ridges, hips, and valleys are present. This is so because no ridge vent is required. Gable end vents provide the vent outlet for the internal space. It also allows for improved airflow of shed roofs. An added feature is the improved aesthetic look of the roof line. Even in long, extended roof ridges, cupolas may be used to vent the roof at predetermined locations. The use of cupolas is an aesthetically pleasing and acceptable roof design feature.

The construction bracket of the present invention may be provided in a variety of configurations. In one embodiment, the construction bracket may include a pivotable junction between the first and second flange. The pivotable junction allows for adaptability and adjustability to practically any roof angle design. "A rafter joining board" may be used to connect a plurality of construction brackets together along each of the first and second flanges to facilitate the joining of all of the roof rafters together. These rafter joining boards are used to connect the rafters together in much the same way a ridge board is used to facilitate joining of roof rafters as currently practiced in the art.

In addition to the use of rafter joining boards, standard joist brackets may also be used to attach to the rafter joining boards to further facilitate the rafter construction/assembly process. In another embodiment, the construction bracket may have joist hangers attached directly to each of the first and second flanges or may be integrally formed with the construction bracket. In yet another embodiment of the present invention, the construction bracket may have a predetermined, continuous length capable of receiving a predetermined number of rafters. An advantage of this embodiment having a pivotable junction allows the framers to attach a predetermined number of rafters to the construction bracket and then raise this "prebuilt" section of roof framing to the desired location. Markings may also be incorporated onto the surface of each flange at locations that match the proper construction code-defined spacing between each rafter to eliminate the need to measure, mark, and attach each rafter according to the required construction code spacing. This has the advantage of also saving time during the framing process.

For roofs of relatively low pitch, another embodiment of the present invention provides a way to insure that a sufficient internal space is formed between the rafters. In this embodiment, the construction bracket includes a base between the first and second flanges. In use, this embodiment has the shape of square-shaped "U" where the extending legs flare away from the inside of the "U". The base, which corresponds to the bottom of the square-shaped "U", provides the necessary spacing between the first and second flanges to create a sufficient internal volume between the rafters. Like the V-shaped construction bracket of the present invention, the first and second flanges may be fixedly attached to each side of the base or they may be pivotably attached allowing for a range of roof pitches.

The U-shaped bracket of the present invention may also have the additional features that the V-shaped bracket may have as described above. Both the U-shaped and V-shaped brackets may incorporate a predetermined amount of insulation at the bottoms of the brackets to further reduce possible heat loss through the bracket. The U-shaped bracket may be further configured to accommodate a ridge beam against the outside surface of the base.

DETAILED DESCRIPTION OF THE PREFERRED EMBODIMENT

Figure 1A:
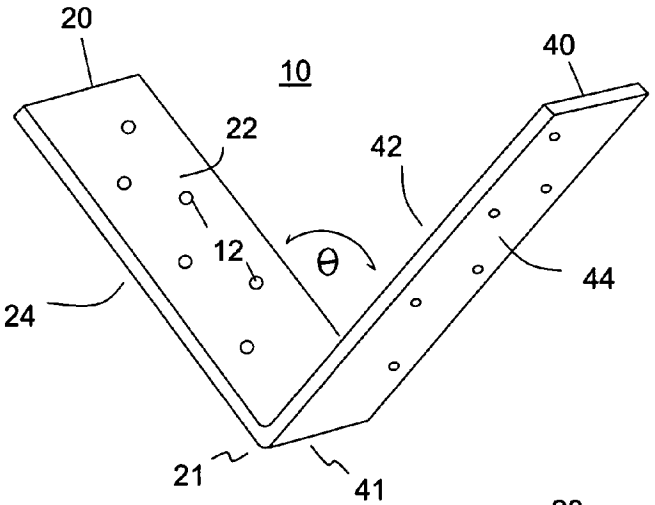
FIGS. 1A and 1B are perspective views of a simplified embodiment of the present invention.
Figure 1B:
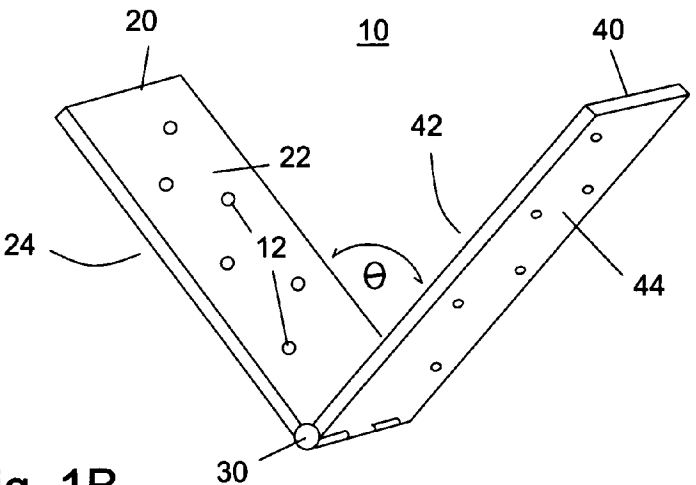

The preferred embodiment(s) of the present invention are illustrated in FIGS. 1-9. FIG. 1A shows a perspective view of a simplified construction bracket 10 of the present invention. Construction bracket 10 includes a first flange 20 having first flange edge 21, a first flange inside surface 22 and a first flange outside surface 24 (not shown), and a second flange 40 having a second flange edge 41, a second flange inside surface 42 (not shown) and a second flange outside surface 44. First flange 20 and second flange 40 are joined along first flange edge 21 and second flange edge 41. Construction bracket 10 may be constructed by connecting first flange 20 to second flange 40 by any means known to those skilled in the art for attaching one flange to another flange. If construction bracket 10 is made of metal, first flange 20 may be welded to second flange 40 at a predetermined angle of separation θ. Construction bracket 10 may also be formed as a single piece such as by casting or stamping. If construction bracket 10 is made of nonmetal, first flange 20 may be attached to second flange 40 using fasteners, adhesives, joining components, etc. Turning now to FIG. 1B, there is illustrated a construction bracket 10 having an adjustable angle of separation θ. Construction bracket 10 includes a hinge 30 joining first flange 20 to second flange 40. Flanges 20 and 40 may optionally include a plurality of holes/openings 12 for receiving construction fasteners such as nails, screws and the like.

Figure 2:
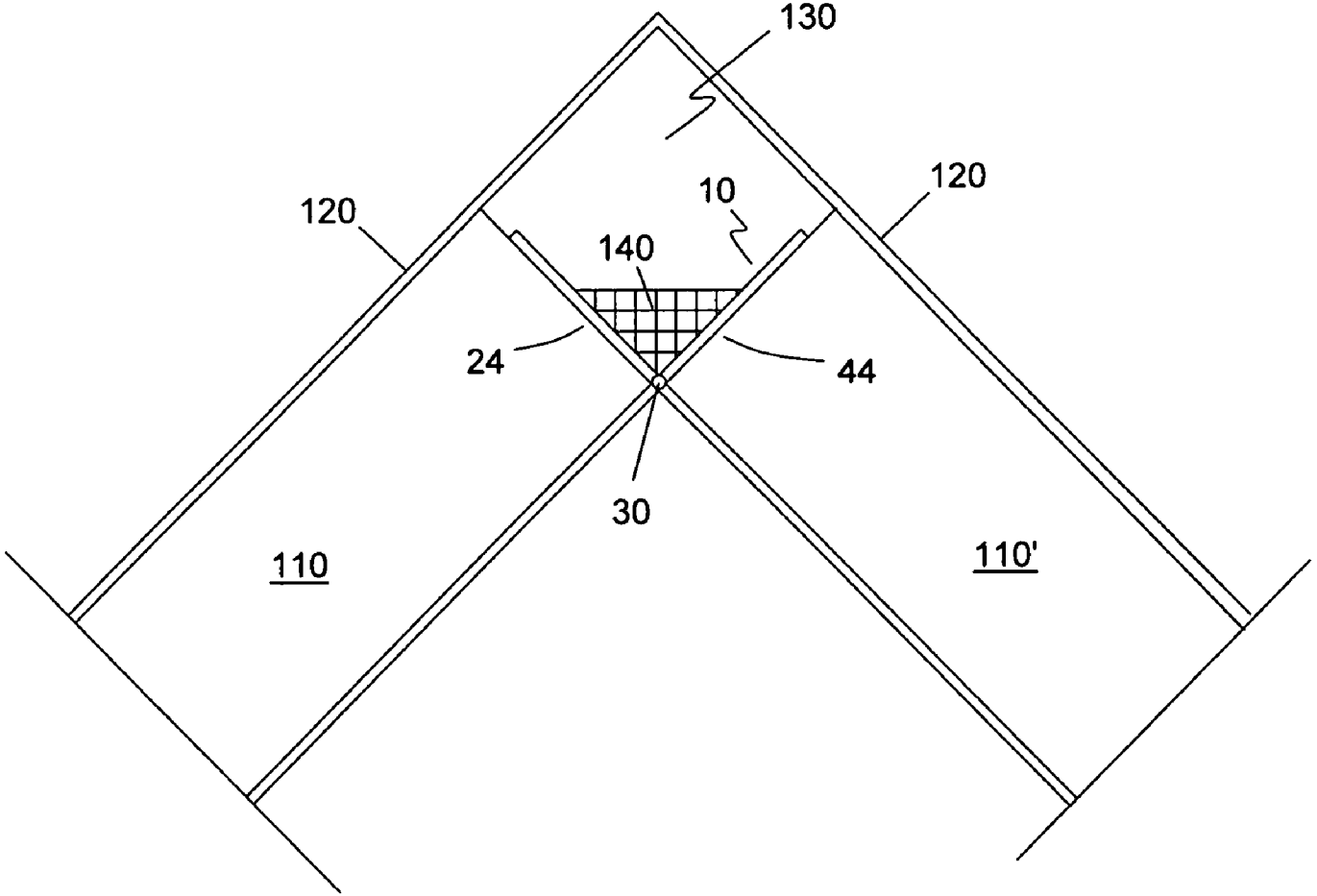
FIG. 2 is a side plan view of one embodiment of the present invention showing rafter ends connected directly to the first and second flanges.

FIG. 2 shows the construction bracket 10 in cross-section in a typical roof frame application. A first rafter 110 is connected to first flange outside surface 24 and a second rafter 110' is connected to second flange outside surface 44. When a covering such as roof sheathing 120 is applied to the rafters to enclose the roof, the plurality of construction brackets 10 form an internal ducting space 130. Optionally, insulation 140 may be provided on the inside of construction bracket 10.

Figure 3:
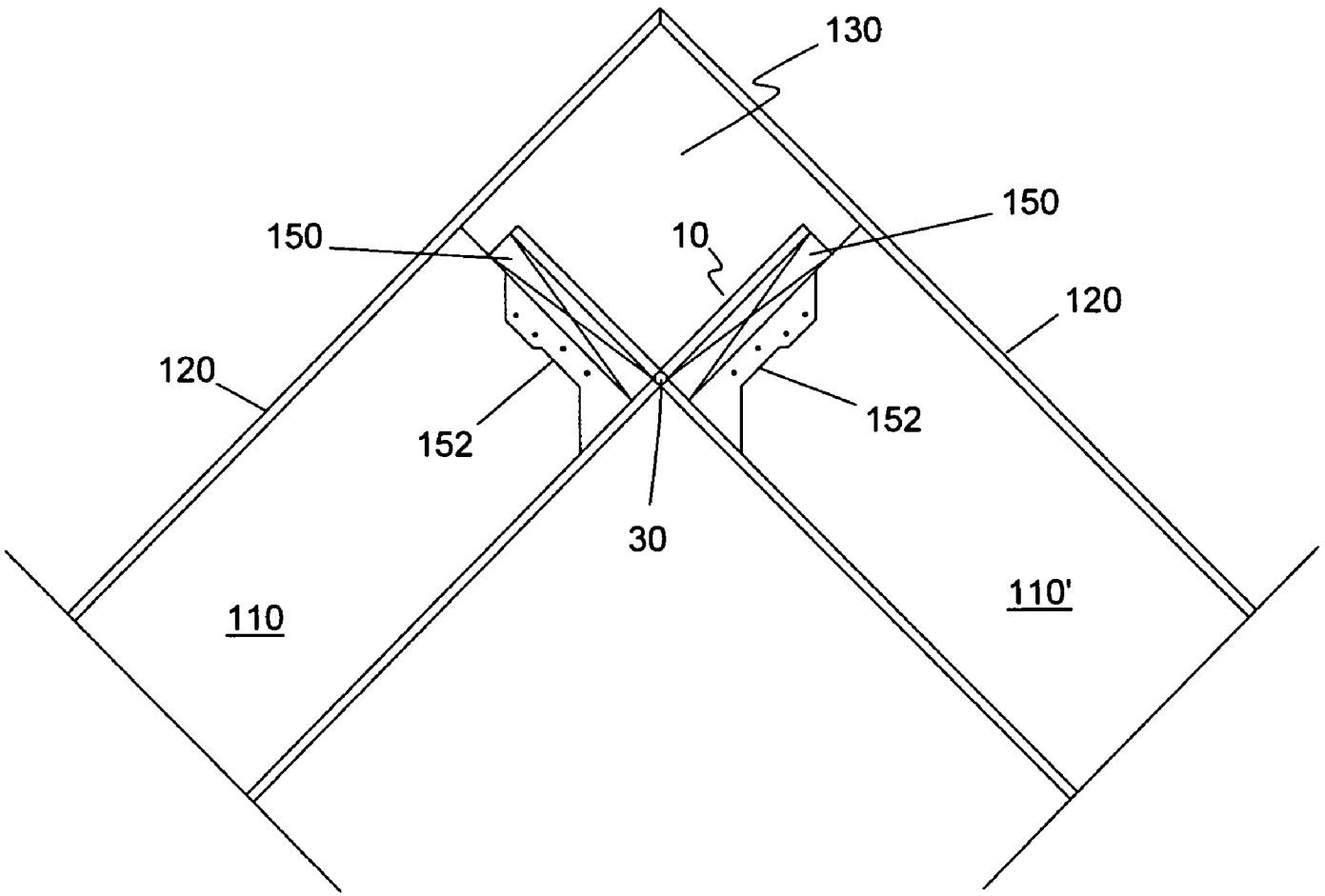
FIG. 3 is a side plan view of the present invention in FIG. 2 showing the use of a rafter connecting board between each of the first and second flanges.

Turning now to FIG. 3, there is illustrated construction bracket 10 where a rafter joining board 150 is incorporated to facilitate the assembly of the roof frame. Rafter joining board 150 joins a plurality of construction brackets 10 much like construction methods currently used where a ridge board is used to join the roof rafters together. Additionally, optional joist hangers 152 may be used to attach rafters 110 and 110' to rafter joining board 150. It should be noted that construction brackets 10 may also be provided with joist hangers already attached to first flange surface 24 and second flange surface 44 forming an integral unit.

Figure 4:
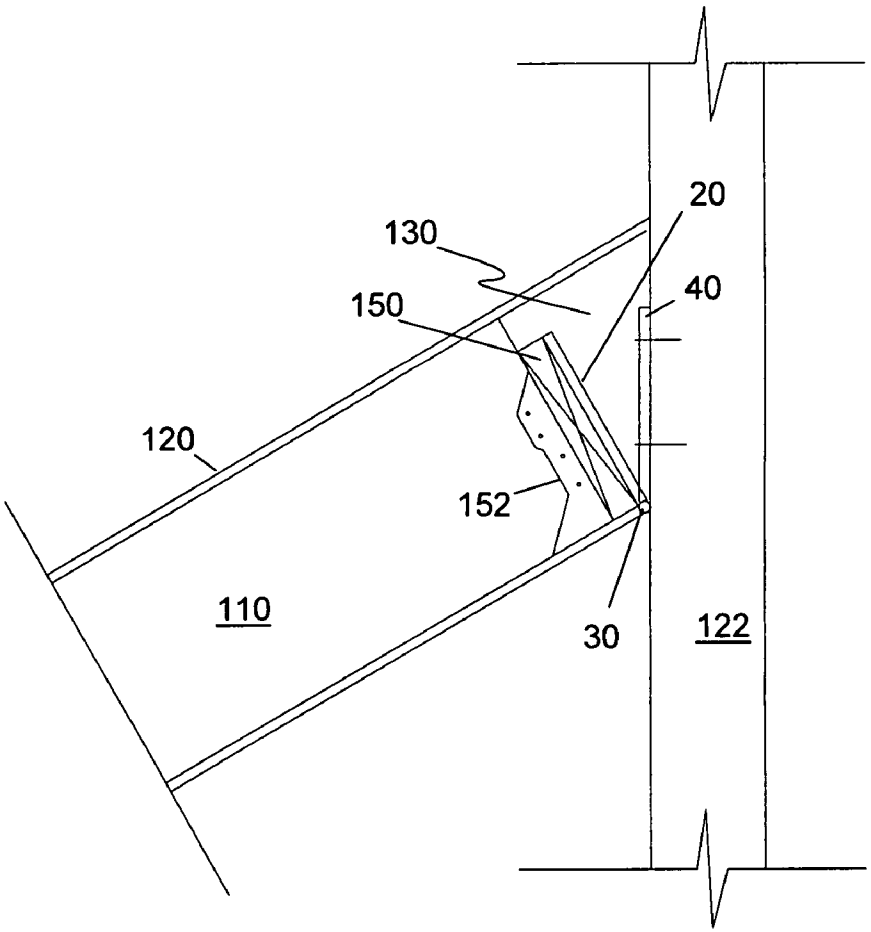
FIG. 4 is a side plan view of the present invention in FIG. 3 showing the use of the construction bracket for connecting the rafter ends of a shed roof to a wall.

Construction bracket 10 may also be used in shed roof construction. FIG. 4 illustrates a partial cross-sectional view of construction bracket 10 connecting shed roof rafter 110 to first flange 20 and second flange 40 attached or connected to wall 122. This illustration shows the use of a rafter joining board 150 and joist hanger 152. It is noted that an internal ducting space 130 is also formed between wall 122 and construction bracket 10 and enclosed by roof sheathing 120. Internal ducting space 130 may be vented with outside wall vents in an unobtrusive and aesthetically pleasing way while providing proper venting to the shed roof.

Figure 5A:
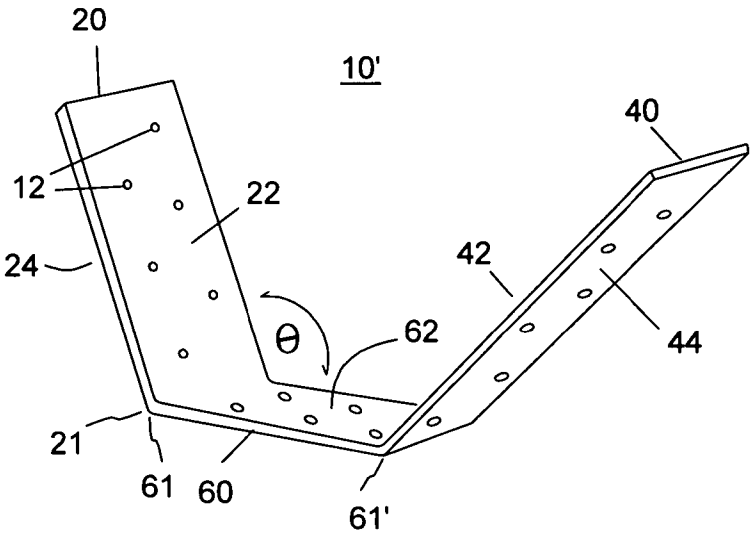
FIGS. 5A and 5B are side plan views of another embodiment of the present invention showing the first and second flanges connected to each other through a base portion.
Figure 5B:
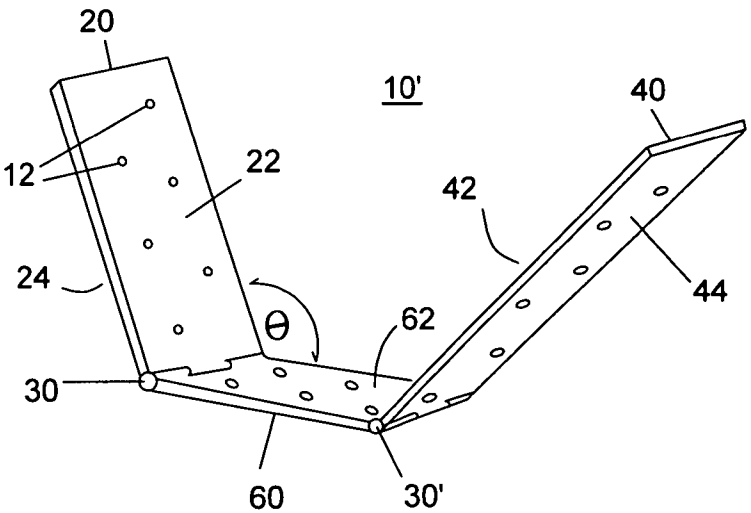

A second embodiment of construction bracket 10 is illustrated in FIGS. 5A and 5B. Turning to FIG. 5A, construction bracket 10' includes a first flange 20 having first flange edge 21, an first flange inside surface 22 and a first flange outside surface 24 (not shown), a base 60 having first base side 61, a second base edge 61', a base inside surface 62, and a base outside surface 64 (not shown) and a second flange 40 having a second flange edge 41, a second flange inside surface 42 (not shown) and a second flange outside surface 44. First flange 20 and second flange 40 are joined to base 60 along first flange edge 21 and first base edge 61 and along second flange side 41 and second base edge 61'.

Construction bracket 10' may be constructed by connecting first flange 20 and second flange 40 to base 60 by any means known to those skilled in the art. If construction bracket 10' is made of metal, first flange 20 and second flange 40 may be welded to first base edge 61 and second base edge 61', respectively, at a predetermined angle of separation θ. Construction bracket 10' may also be formed as a single piece such as by casting or stamping. If construction bracket 10' is made of nonmetal, first flange 20 and second flange 40 may be attached to base 60 using fasteners, adhesives, joining components, etc. Turning now to FIG. 5B, there is illustrated a construction bracket 10' having an adjustable angle of separation θ. Construction bracket 10' includes a first hinge 30 and a second hinge 30' joining first flange 20 and second flange 40 to base 60. Flanges 20 and 40 and base 60 may optionally include a plurality of holes/openings 12 for receiving construction fasteners such as nails, screws and the like.

Figure 6:
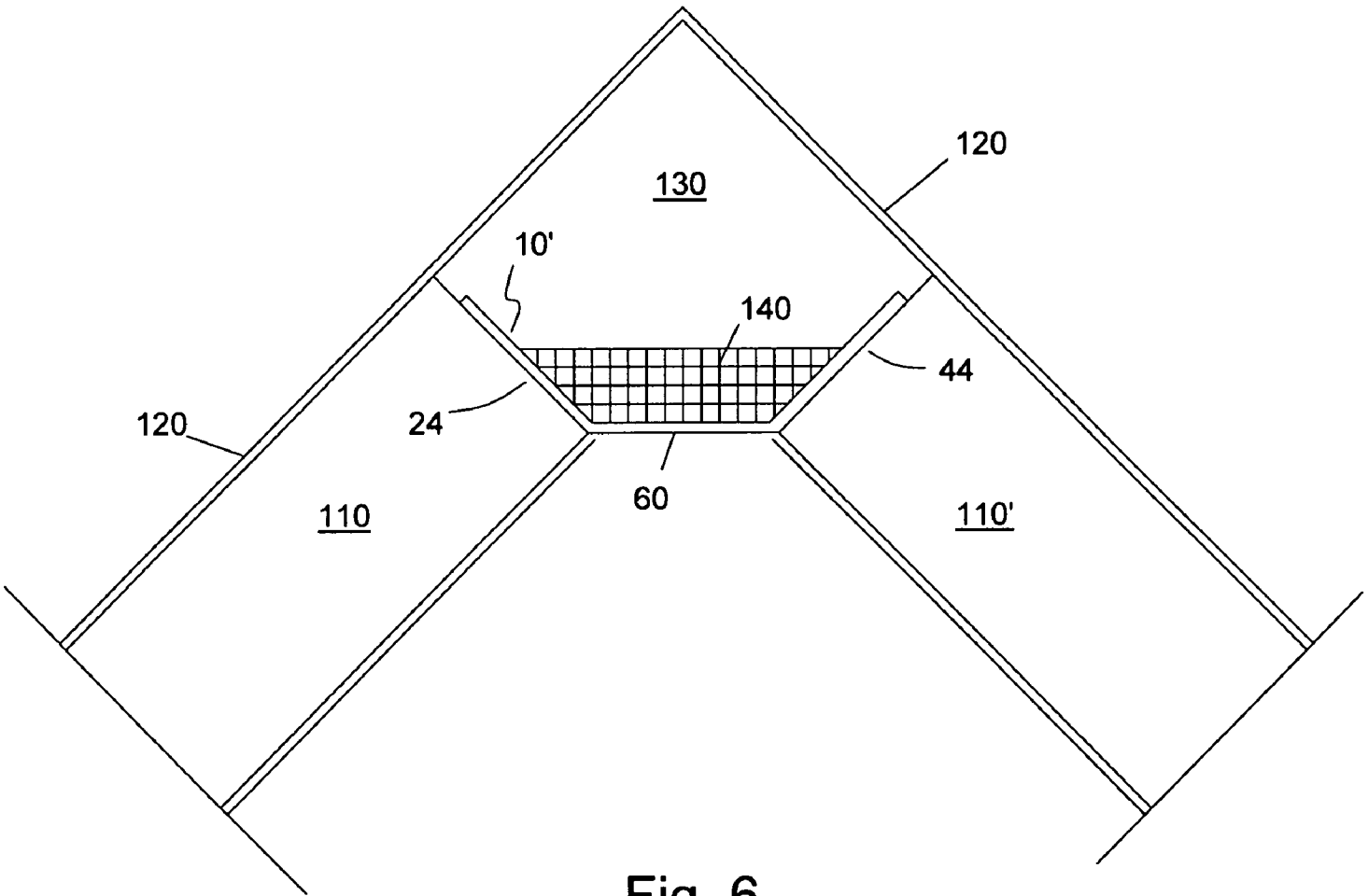
FIG. 6 is a side plan view of the embodiment of the present invention in FIG. 5A showing the rafter ends connected directly to the first and second flanges.

FIG. 6 shows the construction bracket 10' in cross-section in a typical roof frame application. A first rafter 110 is connected to first flange outside surface 24 and a second rafter 110' is connected to second flange outside surface 44. When roof sheathing 120 is applied to the rafters to enclose the roof, the plurality of construction brackets 10' form an internal ducting space 130. Construction bracket 10' is preferably used in roof construction having a relatively low pitch. Base 60 of construction bracket 10' provides a predefined separation between first flange 20 and second flange 40 to allow the formation of internal ducting space 130 having sufficient volume for venting the roof. Optionally, insulation 140 may be provided on the inside of construction bracket 10'.

Figure 7:
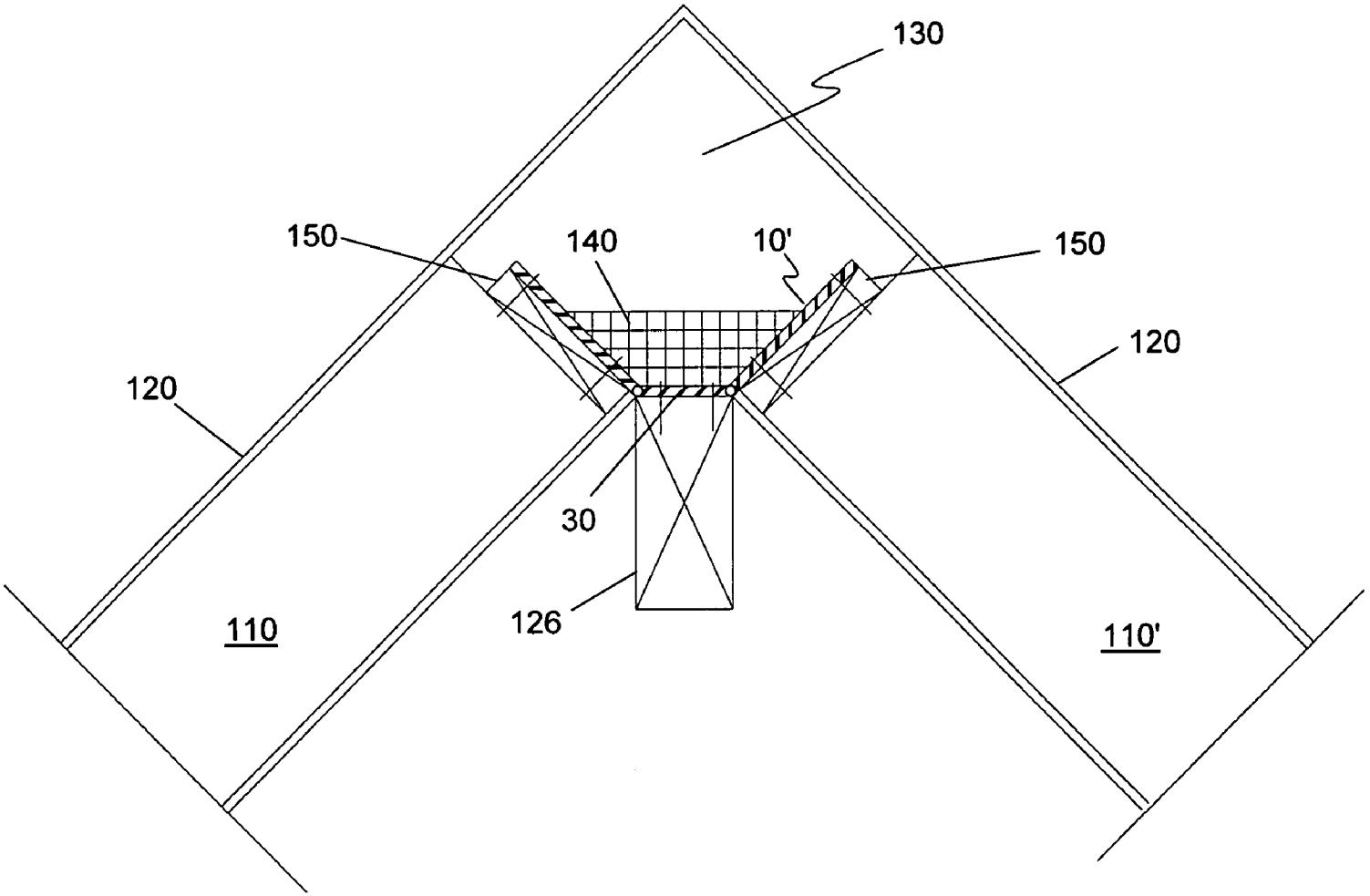
FIG. 7 is a side plan view of the embodiment of the present invention in FIG. 5B showing the use of a rafter connecting board between each of the first and second flanges.

Turning now to FIG. 7, there is illustrated construction bracket 10' where a rafter joining board 150 is incorporated to facilitate the assembly of the roof frame. Rafter joining board 150 joins a plurality of construction brackets 10' much like construction methods currently used where a ridge board is used to join the roof rafters together. Additionally, optional joist hangers 152 may be used to attach rafters 110 and 110' to rafter joining board 150. It should be noted that construction brackets 10' may also be provided with joist hangers already attached to first flange surface 24 and second flange surface 44 as integral components. Base 60 may optionally be attached to a ridge beam 126 in construction where ridge beam 126 is incorporated in the roof design.

It is noted that construction brackets 10 and 10' may be used not only on roof ridges, but may also be incorporated into roof hips, valleys and gables. Even where roof ventilation is not a major concern, construction brackets 10 and 10' will reduce the cost of constructing the roof frame by eliminating the need to make angle cuts at the rafter ends used for framing roof ridges, hips, valley, gables, and shed roofs. Whether I-beams or other dimensioned lumber is used, construction brackets 10 and 10' may be adapted for attachment to the necessary joining structure.

Figure 8:
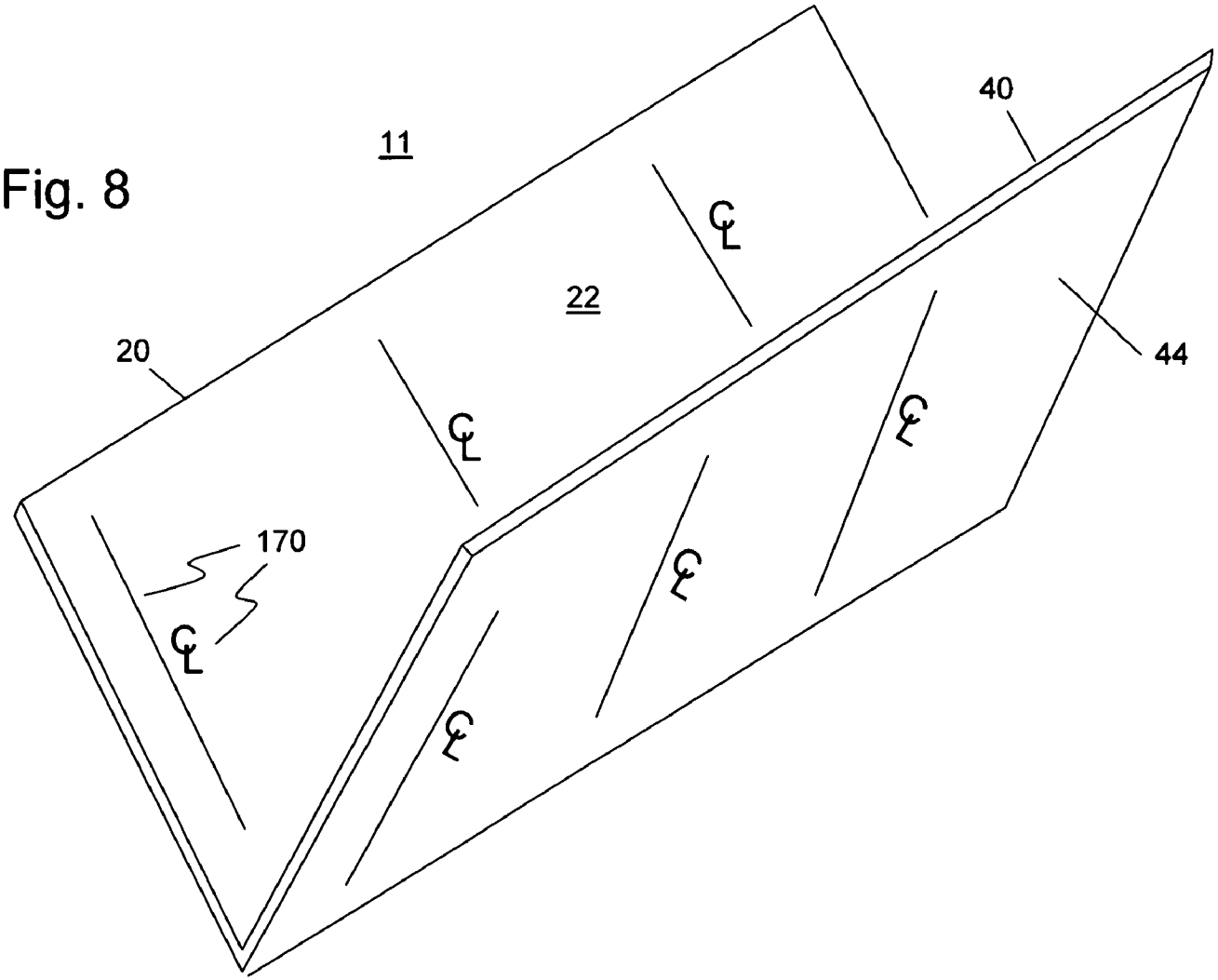
FIG. 8 is a perspective view of another embodiment of the present invention showing an elongated construction bracket with first and second flanges for receiving a plurality of rafters.
Figure 9:
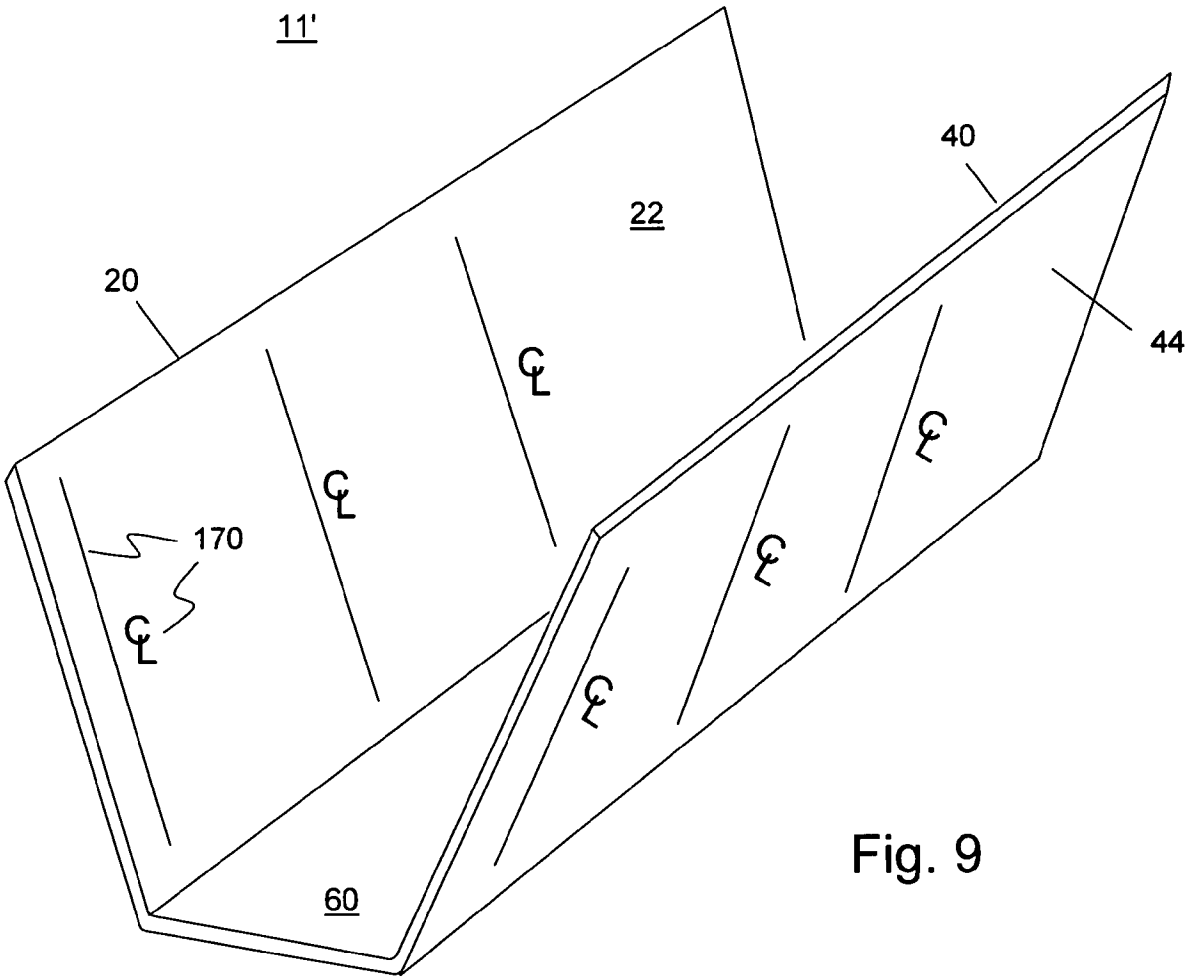
FIG. 9 is a perspective view of another embodiment of the present invention showing an elongated construction bracket with a base and first and second flanges for receiving a plurality of rafters.

Turning now to FIGS. 8 and 9, there is illustrated yet other embodiments of construction brackets 10 and 10'. FIG. 8 shows a construction bracket 11 that is similar to construction bracket 10 but may optionally be of any length to accommodate attachment of a plurality of rafters. This would facilitate pre-assembling of roof sections that could be joined together to form the roof frame. Construction bracket 11 may also include indicia 170 on any of the surfaces 22, 24, 42, and 44 that would indicate proper placement of the roof rafter without requiring the user to measure the required distance between each adjacent rafter.

FIG. 9 shows construction bracket 11' that is similar to construction bracket 10' but may optionally be of any length to accommodate attachment of a plurality of rafters. This would also facilitate pre-assembling of roof sections that could be joined together to form the roof frame. Construction bracket 11' may also include indicia 170 on any of the surfaces 22, 24, 42, and 44 that would indicate proper placement of the roof rafter without requiring the user to measure the required distance between each adjacent rafter.

Figure 10:
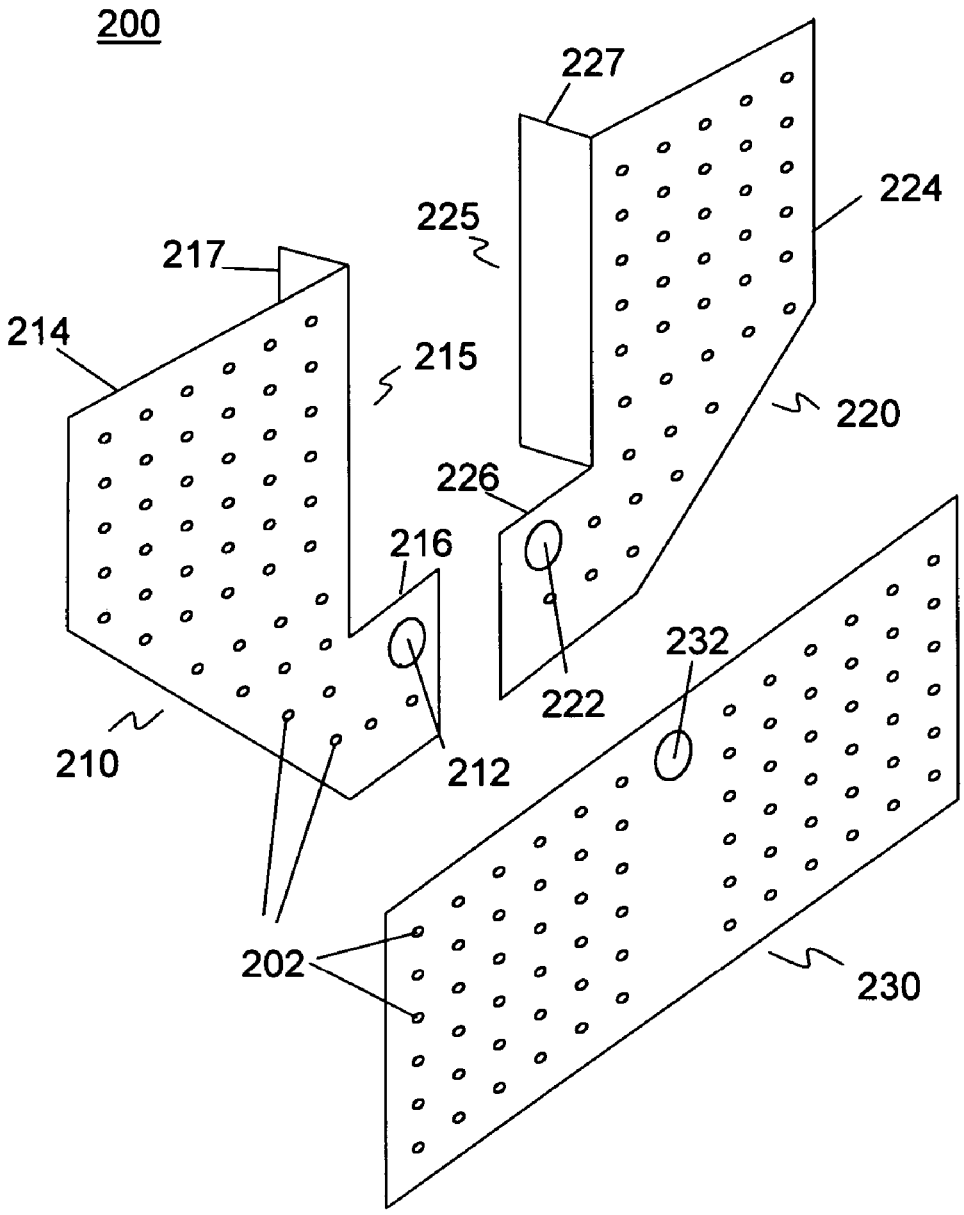
FIG. 10 is a perspective view of another embodiment of the present invention showing a plate-type construction bracket with a pivotable joint.

Turning now to FIG. 10, there is illustrated yet another embodiment of the present invention. Construction bracket 200 includes a first rafter bracket 210, a second rafter bracket 220, and a bracket connecting plate 230. Each of the brackets 210 and 220 and the connecting plate 230 have a pivotable hinge point 212, 222 and 232, respectively. First rafter bracket 210 includes a first bracket plate 214 with a an edge portion 215 having a first bracket pivot extension 216 that is coplanar with plate 214 and a first bracket tab portion 217 extending substantially perpendicular to plate 214. First bracket pivot extension 216 incorporates pivotable hinge point 212. First bracket tab portion 217 is used to abut the end of the rafter to which it is attached.

Second rafter bracket 220 is a mirror-image of first rafter bracket 210 and includes a second bracket plate 224 with a an edge portion 225 having a second bracket pivot extension 226 that is coplanar with plate 224 and a second bracket tab portion 227 extending substantially perpendicular to plate 224. Second bracket pivot extension 226 incorporates pivotable hinge point 222. Second bracket tab portion 227 is used to abut the end of the rafter to which it is attached.

Bracket connecting plate 230 is a substantially flat plate used for securing the construction rafters at a predefined angle of the roof to create the internal duct space 250 (not shown). Bracket connecting plate 230, first rafter bracket 210 and second rafter bracket 220 may be connected to each other at pivotable hinge points 232, 212 and 222 using any known fastening mechanism that permits pivotal movement of the first and second rafter brackets 210 and 220, respectively. One example of an inexpensive fastener is a rivet sized to allow the components of construction bracket 200 to pivot relative to each other. The first and second rafter brackets 210 and 220 and the bracket connection plate 230 each have a plurality of openings 202 for receiving fasteners such as nails or screws or lag bolts or the like for securing the construction bracket 200 to the roof rafters and fixing the angle of the roof rafters.

Figure 11:
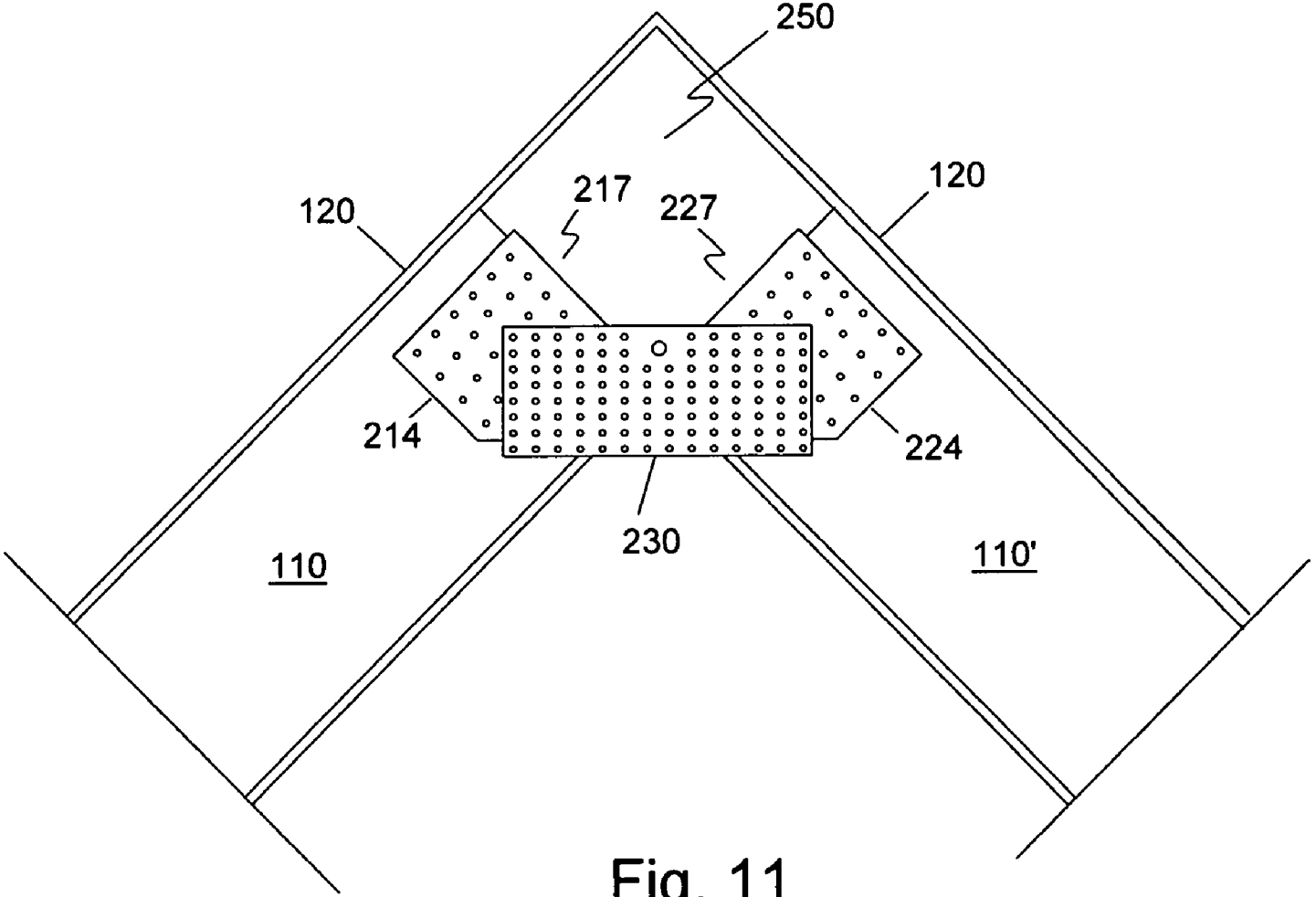
FIG. 11 is a side view of the embodiment in FIG. 10 showing the embodiment mounted to a pair of rafters.

FIG. 11 shows the construction bracket 200 in cross-section in a typical roof frame application. A first rafter 110 is connected to first bracket plate 214 and first bracket tab portion 217 and a second rafter 110' is connected to second bracket plate 224 and second bracket tab portion 227. Once the proper roof angle is set by the user, then bracket connecting plate 230 is secured to first rafter 110 and second rafter 110' through first rafter bracket 210 and through second rafter bracket 220. When roof sheathing 120 is applied to the rafters to enclose the roof, the plurality of construction brackets 200 form an internal ducting space 250.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A method of creating a roof venting space comprising:

assembling a plurality of opposed pairs of transversely-spaced and longitudinally-extending roof rafters having square-cut end faces wherein opposing and aligned ends of each pair of opposed roof rafters of said plurality of roof rafters is secured using a construction bracket having a first flange and a second flange angled to said first flange wherein an outside surface of said first flange is secured against the square-cut end face of one of said pair of opposed roof rafters and an outside surface of said second flange is secured against the square-cut end face of the other of said pair of opposed roof rafters, said first flange and said second flange forming a single, continuous space without any intervening structure between an inside surface of said first flange and an inside surface of said second flange; and attaching a covering to the outside of said plurality of roof rafters wherein said covering covers said space between said first flange and said second flange creating a continuous internal ducting space.

2. The method of claim 1 further comprising pivotally adjusting said construction bracket to obtain a predefined angle between said opposing and aligned ends.

3. The method of claim 1 further comprising securing said construction bracket adjacent to said opposing and aligned ends of said opposed roof rafters.

4. A method of creating a roof venting space comprising:

assembling a plurality of roof rafters wherein at least one square-cut end face of each of said plurality of roof rafters is secured to an outside surface of a first flange of a construction bracket and an outside surface of a second flange of said construction bracket is secured to a surface wherein said first flange is angled to said second flange and spatially positions said plurality of square-cut end faces of said plurality of roof rafters connected to said first flange a predefined distance from said surface creating a single, continuous space without any intervening structure between an inside surface of said first flange and an inside surface of said second flange, said construction bracket of each of said plurality of roof rafters together defining a longitudinally extending space between said square-cut end faces of said plurality of roof rafters and said surface; and attaching a covering to the outside of said plurality of roof rafters wherein said covering covers said space creating a continuous internal ducting space.

5. The method of claim 4 further comprising pivotally adjusting said construction bracket to obtain a predefined angle between said at least one end of said plurality of roof rafters and said surface.

6. The method of claim 4 further comprising securing said construction bracket adjacent to said opposing ends of said opposed roof rafters.

7. The method of claim 4 wherein said surface is square-cut end faces of opposed roof rafters.

8. A method of venting a roof comprising:

creating a continuous internal space at a ridge, hip, or valley of a roof bounded by a covering by attaching an outside surface of a first flange of a construction bracket against a square-cut end face of each of a plurality of transversely-spaced and longitudinally-extending roof rafters, attaching an outside surface of a second flange of said construction bracket against a securing surface wherein said first flange forms an angle to said second flange and said angle defines a single, continuous space without any intervening structure between said first flange and said second flange, and covering said space and said plurality of roof rafters.

9. The method of claim 8 further comprising pivotally adjusting said construction bracket to obtain a predefined angle between said one square-cut end of said plurality of roof rafters and said surface.

10. The method of claim 8 further comprising securing said construction bracket adjacent to said square cut end face of each of said plurality of roof rafters.

11. The method of claim 8 wherein said securing surface is square-cut end faces of opposed roof rafters.

12. The method of claim 11 further comprising pivotally adjusting said construction bracket to obtain a predefined angle between said end face of each of said plurality of roof rafters to said end face of each of said opposed roof rafters.

13. The method of claim 11 further comprising securing said construction bracket adjacent to said end face of one of said plurality of roof rafters to said end face of one of said opposed roof rafters.

* * * * *